United States Patent [19]

Smith

[11] 4,056,076

[45] Nov. 1, 1977

[54] DEVELOPER MIXING SYSTEM

[75] Inventor: Richard E. Smith, Webster, N.Y.

[73] Assignee: Xerox Corporation, Stamford, Conn.

[21] Appl. No.: 571,134

[22] Filed: Apr. 24, 1975

[51] Int. Cl.[2] ..... G03G 15/09

[52] U.S. Cl. ..... 118/653; 118/658

[58] Field of Search ..... 118/637, 612, 602, 612, 118/653, 657, 658, 661; 427/14, 18

[56] References Cited

U.S. PATENT DOCUMENTS

| | | | |
|---|---|---|---|
| 2,910,964 | 11/1959 | Stavrakis et al. | 118/637 |
| 3,180,313 | 4/1965 | Eisner | 118/637 |
| 3,323,933 | 6/1967 | Barford et al. | 118/637 X |
| 3,707,947 | 1/1973 | Reichart, Jr. | 118/637 |
| 3,724,422 | 4/1973 | Latone et al. | 118/637 X |
| 3,930,466 | 1/1976 | Stover | 118/637 |
| 3,948,217 | 4/1976 | Forward | 118/637 |
| 3,960,738 | 6/1976 | O'Brien et al. | 427/14 X |

*Primary Examiner*—Mervin Stein

[57] ABSTRACT

A hybrid crossmixer for blending and mixing the multi-component developer circulating in a development system of an electrostatographic processor comprising an active section in series with a pair of parallel passive sections.

19 Claims, 5 Drawing Figures

DEVELOPER MIXING SYSTEM

BACKGROUND OF THE INVENTION

This invention relates to development systems for electrostatographic processors and, more particularly, to hybrid crossmixers for development systems which employ multi-component developer mixtures.

In a conventional electrostatographic printing process of the type described in Carlson's U.S. Pat. No. 2,297,691 on "Electrophotography", a uniformly charged imaging surface is selectively discharged in an image configuration to provide a latent electrostatic image which is then developed through the application of a finely divided coloring material, called "toner". As is known, that process has enjoyed outstanding commercial sources, especially in plain paper xerographic copiers and duplicators. However, it is not limited to xerography or to use in stand alone copiers and duplicators. For example, there are electrostatographic processors which have appropriately controlled stylii for forming the latent electrostatic image on the imaging surface. Furthermore, it has been found that electrostatographic printing may be advantageously utilized in facsimile systems and computer printers, to name just some non-copier applications.

Multi-component developer mixtures are a favored vehicle for providing the necessary toner to render electrostatic latent images visible. A developer of this type contains a mixture of toner particles and larger, so-called "carrier" particles. In practice, the materials for the toner and carrier (or, sometimes, carrier coating) components of the mixture are selected so that they are removed from one another in the triboelectric series, whereby electrical charges of opposite polarities tend to be imparted to the toner and carrier particles when the developer components are blended together. Moreover, in selecting those materials, consideration is given to their triboelectric ranking to the end that the nominal polarity for the charge of the toner particles opposes the polarity of the latent images which are to be developed. Consequently, in operation, there are competing electrostatic forces acting on the toner particles. That is, one set of forces tends to attract the toner particles to the carrier particles, while another set of forces tends to electrostatically strip toner from that portion of the developer which is brought into the immediate proximity of or actual contact with the image bearing imaging surface.

Cascade and magnetic brush development systems have both been used with substantial success in continuous electrostatographic processors. Characteristically, those systems circulate a multi-component developer from a sump, through a development zone, and then back to the sump. The aim, of course, is to develop the latent images carried by the imaging surface on the fly — viz., as the imaging surface moves through the development zone. Hence, there typically is a toner dispenser for adding additional toner to the developer from time-to-time so that the toner concentration of the developer remains at a suitably high level. Furthermore, there normally is a crossmixer for mixing and blending the components of the developer.

As used herein, "mixing" refers to redistributing the developer components in order to maintain a more or less uniform distribution of the available toner. In contrast, "blending" refers to agitating the developer in order to promote the triboelectric charging of the toner and carrier particles.

Surprisingly, most of the available crossmixers still show a weakness when measured by their ability to carry out the dual functions of mixing and blending a multi-component developers. As a general rule, passive crossmixers are effective mixing devices, but only marginally acceptable as blending devices. Active crossmixers, on the other hand, are normally effective blending devices, but only marginally acceptable as mixing devices. The crossmixer described and claimed in my copending and commonly assigned United States Patent application which was filed Feb. 27, 1975 now U.S. Pat. No. 3,943,887 is a distinct improvement, but there still is room for further improvement.

SUMMARY OF THE INVENTION

Accordingly, an object of this invention is to provide an improved hybrid crossmixer. More particularly, an object is to provide a hybrid crossmixer which has a series configuration.

Briefly, to carry out those and other objects of the invention, there is a hybrid crossmixer comprising active and passive sections which are operated in series to sequentially blend and mix the toner and carrier components of a multicomponent developer circulating in a development system for an electrostatographic processor.

BRIEF DESCRIPTION OF THE DRAWINGS

Still further objects and advantages of the present invention will become apparent when the following detailed description is read in conjunction with the attached drawings, in which.

DETAILED DESCRIPTION OF THE ILLUSTRATED EMBODIMENT

While the invention is described in some detail hereinafter with specific reference to certain embodiments it is to be understood that there is no intent to limit it to those embodiments. On the contrary, the aim is to cover all modifications, alternatives and equivalents falling within the spirit and scope of the invention as defined by the appended claims.

Figure 1:
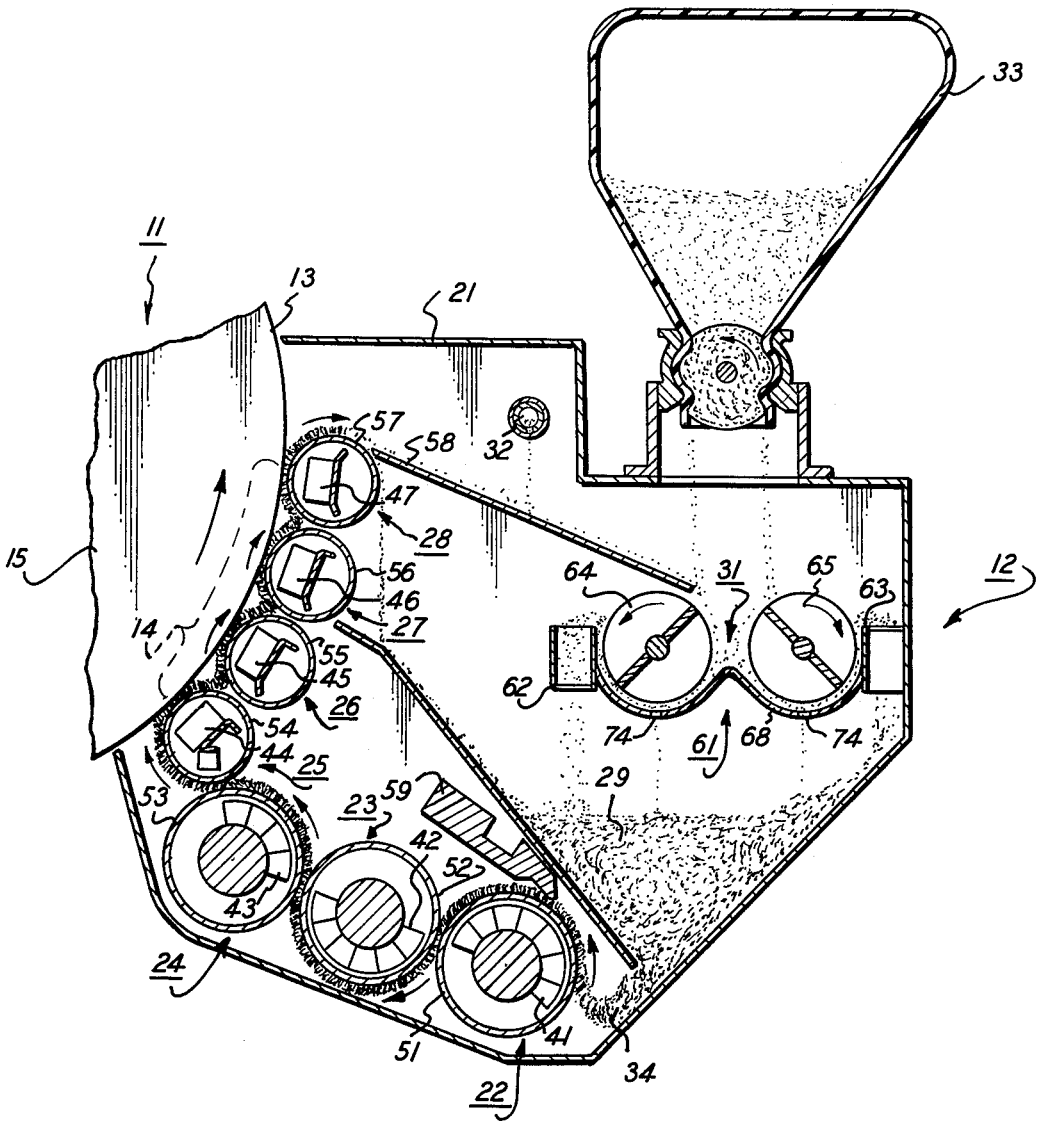
FIG. 1 is a fragmentary, sectional view of an electrostatographic processor having a development system comprising a hybrid crossmixer constructed in accordance with this invention.

Turning now to the drawings, and at this point especially to FIG. 1, there is an electrostatographic processor 11 (shown only in relevant part) having a magnetic brush development system 12 for developing latent electrostatic images carried by an electrically insulative imaging surface 13 on the fly — viz., as the imaging surface 13 moves through a development zone 14. In this instance, the processor 11 is a more or less conventional xerographic copier having a rotatably driven drum 15 coated with a photo conductive imaging surface 13.

As shown, the development system 12 comprises a housing 21 having a series of transport rolls 22-24 and a series of applicator rolls 25-28 for circulating developer along a path which runs from a sump 29 in the lower reaches of the housing 21, through the development zone 14, and then back to the sump 29 via a crossmixer 31. In keeping with generally accepted practices, the developer comprises a mixture of triboelectrically charged toner particles and ferromagnetic carrier particles. Advantageously, there is a port 32 for returning reclaimed toner to the development system 12 from, say, a photoreceptor cleaning system (not shown). Additionally, there is a toner dispenser 33 for adding fresh or virgin toner to the developer from time-to-time so that its toner concentration remains at a suitably high level.

More particularly, in operation, developer is gravity fed through an elongated discharge orifice or slot 34 at the bottom of the sump 29 and is then magnetically constrained to follow a generally S-shaped path through the transport rolls 22-24 and to thereafter advance upwardly between the photoconductor 13 and successive ones of the applicator rolls 25-28. To that end, the transport rolls 22-24 and the applicator rolls 25-28 comprise individual permanent magnet assemblies 41-47 which are stationarily supported within separate non-magnetic sleeves 51-57, respectively. The magnetic assemblies 41-47 and the sleeves 51-57 typically extend across substantially the full width of the development zone 14. Moreover, the sleeves 51-57 are rotatably driven (by means not shown) in the directions indicated by the arrows so that the developer magnetically entrained thereon under the influence of the magnetic fields provided by the magnetic assemblies 41-47 is transported, as above described, from the sump 29 to the last or uppermost applicator roll 28. After passing between that roll and the photoconductor 13, the developer is discharged onto a downwardly sloping ramp 58 which guides it into the crossmixer 31 as more fully described hereinbelow.

As is usually the case in development systems of this type, the sleeves 54-57 of the applicator rolls 25-28 are spaced a predetermined short distance from the photoconductor 13, and the magnetic fields emanating from the magnetic assemblies 44-47 are shaped to cause the developer on the sleeves 54-57 to form bristle-like stacks or streamers which bridge that space. Hence, the developer brushes against the photoconductor 13 while passing between the photoconductor and each of the sleeves 54-57, thereby developing any latent images which happen to be present. Desirably, of course, there is a more or less uniform flow of developer across the full width of the development zone 14. Consequently, in the illustrated embodiment, there is a trimmer bar 59 for leveling the profile of the developer entrained on the sleeve 51 of the first transport roll 22.

In accordance with this invention, the crossmixer 31 has a series hybrid configuration and, therefore, tends to sequentially blend and mix the developer and any free toner (i.e., reclaimed and/or fresh toner) flowing toward the sump 29. A compact unit of that type comprises a driven or active section 61 which is effectively in series with a pair of parallel passive sections 62 and 63. Each of those sections 61-63 extends across substantially the full width of the developer housing 21. However, there is a series/parallel relationship because the passive sections 62 and 63 are located forwardly and rearwardly, respectively, of the active section 61 which, in turn, is positioned to intercept the incoming flow of developer and toner.

Figure 2:
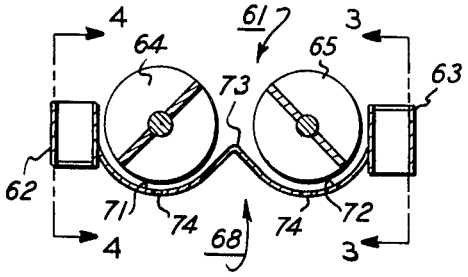
FIG. 2 is another sectional view of the crossmixer shown in FIG. 1.
Figure 3:
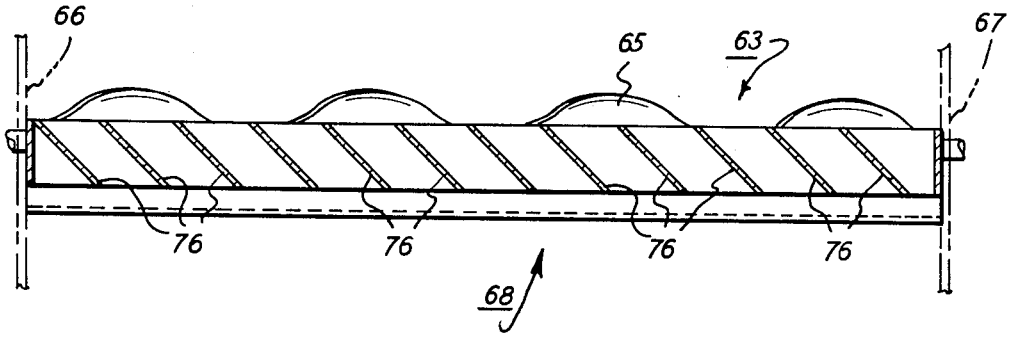
FIG. 3 is a cross section taken along the line 3-3 in FIG. 2 looking in the direction of the arrows to illustrate that crossmixer in additional detail.
Figure 4:
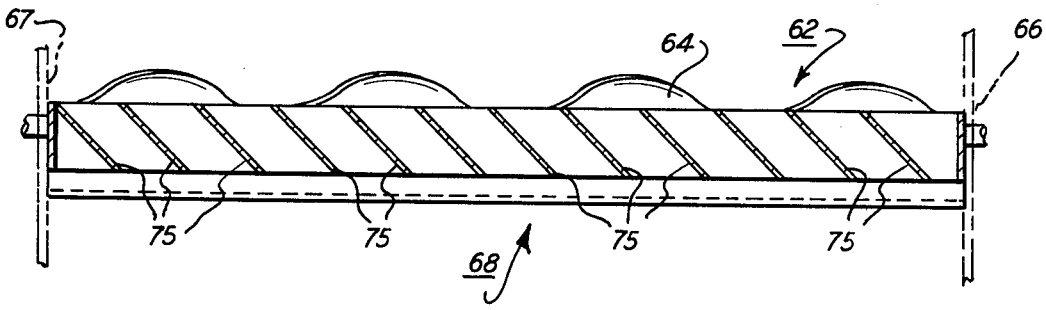
FIG. 4 is another cross section taken along the line 4—4 in FIG. 2 looking in the direction of the arrows to further illustrate that crossmixer.

More particularly, as shown in some additional detail in FIGS. 2-4, the active section 61 splits the developer and toner so that separate parts thereof are fed toward the passive sections 62 and 63 during the blending process. To accomplish that, it suitably includes a pair of screw-type augers 64 and 65, which are journalled for rotation in the opposite sidewalls 66 and 67 of the housing 21 above a baffle 68 which is bridged between the sidewalls 66 and 67. The baffle 68 has a pair of generally U-shaped channels 71 and 72, which underlie and partially cup the augers 64 and 65, respectively, and a central flow splitting region 73, which is aligned with the toner dispenser 33 and the ramp 58 to more or less evenly divide the incoming flow of developer and toner between the channels 71 and 72. Consequently, in operation, the augers 64 and 65 are partially submerged in separate, locally confined and continuously changing supplies of toner and developer.

To carry out the blending process, the augers 64 and 65 are counter-rotated (by means not shown) to agitate the developer and toner within the channels 71 and 72 while feeding it outwardly in opposite, generally radial directions toward the passive sections 62 and 63, respectively. As will be appreciated, some mixing also takes place during that process inasmuch as the augers 64 and 65 inherently impart both radial and longitudinal components of motion to the developer and toner. Thus, to take advantage of that, the augers 64 and 65 preferably have the same hand (e.g., they may both be right-hand devices) so that they longitudinally translate the developer and toner being blended in opposite directions toward the sidewalls 66 and 67, respectively. If desired, of course, the baffle 68 may be perforated as at 74, thereby permitting a part of the blended developer and toner (hereinafter referred to simply as "blended developer") to bypass the passive sections 62 and 63.

Nevertheless, in keeping with this invention, the passive sections 62 and 63 play a significant role in mixing the blended developer and toner. As will be seen, one of those sections 62 is secured to or otherwise held against the forward side of the baffle 68 to be fed by the auger 64, and the other such section 63 is similarly stationed adjacent the rearward side of the baffle 68 to be fed by the auger 65. To carry out the mixing function, there are separate sets of downwardly and sidewardly inclined deflector vanes 75 and 76 internally supported within the passive sections 62 and 63, respectively, at spaced apart intervals across the developer housing 21. Desirably, the mixing action of the passive sections 62 and 63 is additive with the mixing action of the augers 64 and 65, respectively. To that end, the vanes 75 are inclined toward the sidewall 71, and the vanes 76 are oppositely inclined toward the other sidewall 72.

Figure 5:
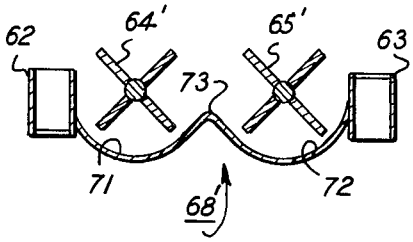
FIG. 5 is a sectional view of an alternative embodiment for the crossmixer

Turning to FIG. 5, it will be apparent that the mixing action of the augers 64 and 65 is advantageous, but not essential. Indeed, they may be replaced by paddle wheels 64' and 65', without departing from the basic principles of this invention. Preferably, when the paddle wheels 64' and 65' are used, the baffle 68' is solid to prevent the blended developer and toner from bypassing the passive sections 62 and 63. Otherwise, however, this embodiment is very much like the one previously described as indicated by the use of like reference numerals to identify like parts.

CONCLUSION

In view of the foregoing, it should be apparent that the hybrid crossmixer provided by the present invention is a synergistic combination which leads to superior mixing and blending of the toner and carrier components of multicomponent developers for electrostatographic processors.

What is claimed is:

1. In a development system for developing latent electrostatic images carried by an imaging surface of an electrostatographic processor; said development system including a housing having a sump for storing a supply of multi-component developer, and means within said housing for circulating developer along a path running from said sump, through a development zone, and then back into said sump; the improvement comprising series hybrid crossmixing means disposed in said path between said sump and said development zone, said crossmixing means including an active section in series with at least one passive section for sequentially blending and mixing developer circulating along said path, said crossmixing means including a pair of parallel passive sections in series with said active section, said passive sections having separate sets of spaced apart, internal deflector vanes which are downwardly inclined to deflect developer toward opposite sides of said housing,

2. The improvement of claim 1 wherein said active section and said passive section extend transversely of said development zone between opposed sidewalls of said housing, and said sections are downstream of said development zone to blend and mix developer returning toward said sump.

3. The improvement of claim 2 wherein said development system further includes means upstream of said crossmixing means for adding additional toner to said developer from time-to-time, whereby said crossmixing means blends and mixes the additional toner in with the developer returning toward said sump.

4. The improvement of claim 3 wherein said passive section is downstream of said active section, whereby the blending and mixing of the developer are sequentially carried out in the order named.

5. The improvement of claim 1 wherein said active section is upstream of said passive sections, whereby the blending and mixing of the developer are carried out sequentially in the order named.

6. The improvement of claim 5 wherein said development system further includes a toner dispenser mounted on said housing above said crossmixing means for adding fresh toner to said developer from time-to-time, whereby said crossmixing means blends and mixes the fresh toner in with the circulating developer.

7. The improvement of claim 1 wherein said active section and said passive sections extend transversely of said development zone between opposed sidewalls of said housing, said active section is centrally positioned between said passive sections to intercept the developer circulating in said path, said active section includes means for blending the intercepted developer and for feeding the blended developer in parallel to said passive sections, the deflector vanes of one of said passive sections are inclined toward one of the sidewalls of said housing to deflect developer toward said one of the sidewalls of said housing to deflect developer toward said one sidewall, and the deflector vanes of the other of said passive sections are inclined toward the opposite sidewall of said housing to deflect blended developer toward said opposite sidewall.

8. The improvement of claim 7 wherein said active section and said passive sections are downstream of said development zone to blend and mix the developer returning toward said sump.

9. The improvement of claim 8 wherein said development system further includes means upstream of said crossmixing means for adding additional toner to said developer from time-to-time, whereby said crossmixing means blends and mixes the additional toner in with the developer returning toward said sump.

10. The improvement of claim 1 wherein said passive sections are forwardly and rearwardly, respectively, of said active section, and said active section includes a baffle bridged between opposed sidewalls of said housing and a pair of augers journalled for rotation in said sidewalls above said baffle; said baffle having a pair of generally U-shaped channels underlying and partially cupping respective ones of said augers, and a central flow splitting region positioned to divide the developer circulating in said path between said channels; said augers being counter-rotatable, whereby one of said augers radially translates blended developer toward one of said passive sections while the other of said augers radially translates blended developer toward the other of said passive sections.

11. The improvement of claim 10 wherein the deflector vanes of one of said passive sections are downwardly inclined toward one of the sidewalls of said housing to deflect developer toward said one sidewall, and the deflector vanes of the other of said passive sections are downwardly inclined toward the opposite sidewall of said housing to deflect blended developer toward said opposite sidewall.

12. The improvement of claim 11 wherein said augers have the same hand and are selected to aid said one and said other passive sections in deflecting said developer toward said one sidewall and said opposite sidewall, respectively.

13. The improvement of claim 12 wherein said baffle is apertured, whereby a part of the blended developer bypasses said passive sections.

14. The improvement of claim 12 wherein said development system further includes a toner dispenser mounted on said housing above the flow splitting region of said baffle for adding additional toner to the developer from time-to-time, whereby said crossmixing means blends and mixes the additional toner it with the circulating developer.

15. The improvement of claim 12 wherein said active section and said passive sections are downstream of said development zone to blend and mix the developer returning toward said sump.

16. The improvement of claim 1 wherein said passive sections are forwardly and rearwardly, respectively, of said active sections, and said active section includes a baffle bridge between opposed sidewalls of said housing and a pair of paddle wheels journalled for rotation in said sidewalls above said baffle; said baffle having a pair of generally U-shaped channels underlying and partially cupping respective ones of said paddle wheels, and a central flow splitting region positioned to divide the developer circulating in said path between said channels; said paddle wheels being counterrotatable, whereby one of said paddle wheels radially translates blended developer toward one of said passive sections while the other of said paddle wheels radially translates blended developer toward the other of said passive sections.

17. The improvement of claim 16 wherein the deflector vanes of one of said passive sections are downwardly inclined toward one of the sidewalls of said housing to deflect developer toward said one sidewall, and the deflector vanes of the other of said passive sections are downwardly inclined toward the opposite sidewall of said housing to deflect blended developer toward said opposite sidewall.

18. The improvement of claim 17 wherein said active section and said passive sections are downstream of said development zone to blend and mix the developer returning toward said sump.

19. The improvement of claim 18 wherein said development system further includes a toner dispenser mounted on said housing above the flow splitting region of said baffle for adding additional toner to said developer from time-to-time, whereby said active section and said passive sections blend and mix the additional toner in with the developer returning toward said sump.

* * * * *